United States Patent [19]

Bucey et al.

[11] 4,171,015

[45] Oct. 16, 1979

[54] HEAT EXCHANGER TUBE AND METHOD OF MAKING SAME

[75] Inventors: Charles W. Bucey; Kenneth J. Miller, both of Peoria; Ronald R. Robinson, Morton, all of Ill.

[73] Assignee: Caterpillar Tractor Co., Peoria, Ill.

[21] Appl. No.: 782,200

[22] Filed: Mar. 28, 1977

[51] Int. Cl.[2] ..... F28F 1/26

[52] U.S. Cl. ..... 165/181; 29/157.3 A; 113/118 A

[58] Field of Search ..... 165/181, 177, 179; 29/157.3 A, 157.3 D, 157.3 V, 157.3 R; 113/118 A, 118 R

[56] References Cited

U.S. PATENT DOCUMENTS

| | | | |
|---|---|---|---|
| 2,118,060 | 5/1938 | Stone et al. | 165/179 X |
| 2,554,185 | 5/1951 | Glegerich | 165/170 |
| 2,819,731 | 1/1958 | Louthan | 165/177 X |
| 3,119,446 | 1/1964 | Weiss | 165/179 X |
| 3,545,062 | 12/1970 | Cox | 29/157.3 V |
| 3,673,846 | 7/1972 | Levington et al. | 72/326 |
| 3,845,814 | 11/1974 | Kun | 29/157.3 A |

FOREIGN PATENT DOCUMENTS 713776 8/1954 United Kingdom .

*Primary Examiner*—Albert W. Davis, Jr.
*Attorney, Agent, or Firm*—Charles E. Lanchantin, Jr.

[57] ABSTRACT

A heat exchanger tube has a first asymmetrically corrugated sheet portion having an opposite pair of longitudinally extending side edge portions, a plurality of substantially transversely extending ribs and a substantially uninterrupted inner surface, a second asymmetrically corrugated sheet portion having an opposite pair of longitudinally extending side edge portions, a plurality of substantially transversely extending ribs and a substantially uninterrupted inner surface, and at least one joint for connecting side edge portions of the first and second corrugated sheet portions forming a tube and providing an internal flow path for a first fluid and a plurality of external flow paths for a second fluid.

3 Claims, 13 Drawing Figures

HEAT EXCHANGER TUBE AND METHOD OF MAKING SAME

BACKGROUND OF THE INVENTION

The present invention is related to a heat exchanger tube, and particularly to a tube-fin heat exchanger tube and method of making the same.

Heat exchangers incorporating a plurality of tubes through which a hot fluid circulates between upper and lower tanks or headers are well known. Unfortunately, it is also known that the brazed or soldered joints between these tubes and their associated heat dissipating fins present a continual service problem. A single defective joint can cause a leakage problem which requires the removal of the heat exchanger from its associated power plant for complicated and expensive repair. In order to avoid such potential leakage problems the joints are frequently overbrazed, and this can result in partial blocking of the fluid flow and impairment of the overall efficiency of the heat exchanger.

One known heat exchanger employs a plurality of tubes with a cylindrical configuration with integral spiral fins formed thereon by an extrusion process. Still another heat exchanger utilizes cylindrical tubes with folded fins which are produced first by fluting the tube, and then by twisting and compressing it. Manufacturing complexities are involved with the production of these tubes, and they are limited to certain dimensions because of the method of making them. For example, both of these tubes are undesirably restricted to cylindrical shapes.

Another heat exchanger tube, namely that disclosed in U.S. Pat. No. 3,119,446 issued Jan. 28, 1964 to G. Weiss, embodies a facing pair of symmetrical corrugated sheets which are interconnected at both sides thereof by complex intermeshed edge portions. Such expensive construction undesirably provides equal amounts of exposed surface area on the inside and on the outside of the tube, a tortuous route for fluid travel internally thereof, and extended regions of potential leakage at the joints thereof.

SUMMARY OF THE INVENTION

The present invention is directed to overcoming one or more of the problems as set forth above.

According to the present invention, a heat exchanger tube is provided having a first corrugated sheet portion which has an opposite pair of longitudinally extending side edge portions, a plurality of substantially transversely extending ribs and a substantially uninterrupted inner surface, a second corrugated sheet portion which has an opposite pair of longitudinally extending side edge portions, a plurality of substantially transversely extending ribs and a substantially uninterrupted inner surface, and means for connecting the side edge portions of the first and second corrugated sheet portions to form a tube. In this way the tube provides an internal flow path for a first fluid and a plurality of external flow paths for a second fluid traveling generally transversely to the internal flow path.

DESCRIPTION OF A BASIC EMBODIMENT

Figure 4:
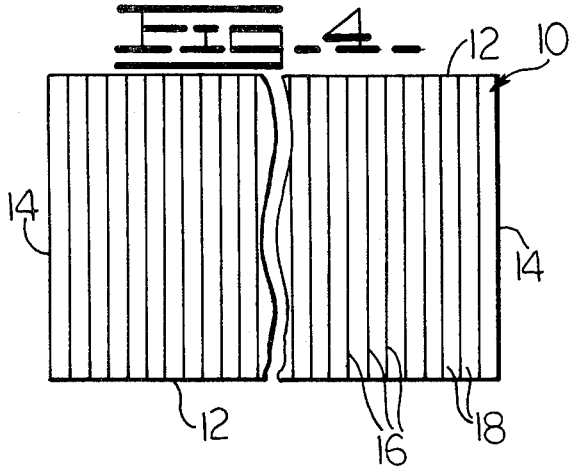
FIG. 4 is a diagrammatic top plan view of a corrugated sheet of material which is used to make the heat exchanger tube of FIG. 1.

Referring initially to FIG. 4, an asymmetrically corrugated sheet 10 having opposite sides 12 and opposite ends 14 is shown which is formed from a relatively thin, corrosion and heat-resistant alloy metal having maximum ductility and formability properties. The sheet is formed from a solution-annealed stainless steel sheet of relatively uniform thickness selected from a thickness range between approximately 0.051 mm (0.002")and 0.127 mm (0.005"), with a thickness of about 0.076 mm (0.003") being preferred. As best shown in longitudinal section at the upper part of FIG. 2, the corrugated sheet has a plurality of transversely extending ribs 16 which are integrally connected by relatively flat members 17 to collectively define grooves or channels 18 therebetween. In the instant embodiment, each rib has a distal edge or apex 20 which extends transversely across the sheet in a straight line. The sheet of FIG. 4 is preferably made by initially folding or pleating it in an apparatus of the type shown in U.S. Pat. No. 3,892,119, issued July 1, 1975 to K. J. Miller, et al, and the pleats thus formed subsequently compressed in a similar apparatus to close juxtaposed walls tightly together. In this way each rib has a flattened V-shape with a narrow base 22 of at least two sheet thicknesses and which thereby defines a substantially closed and inwardly opening slot 24. Because the bottom of each groove is substantially flat, a series of juxtaposed inner surfaces 26 is provided. Such surfaces are collectively arranged in a common internal plane 28 to form a substantially uninterrupted or relatively smooth inner planar surface thereat, being interrupted only to a minor degree by the slots 24. A typical height for the ribs may be about 4 mm (0.157"), and a typical spacing between the apexes thereof may be about 1 mm (0.040"), so that it is apparent that a relatively large external surface area is provided in a compact section.

Figure 5:
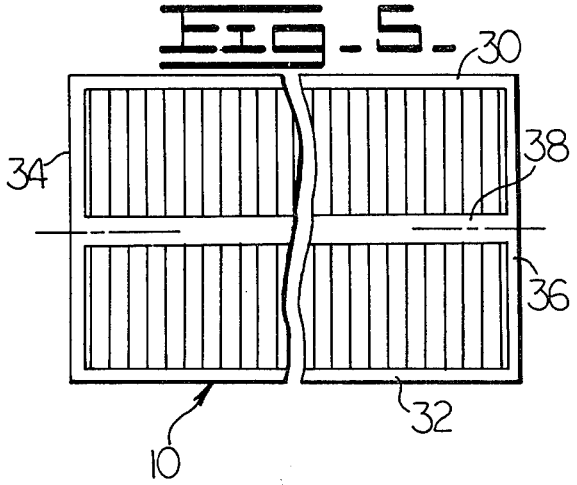
FIG. 5 is a plan view of the corrugated sheet of FIG. 4 with the peripheral edge portions and the center section thereof flattened.
Figure 6:
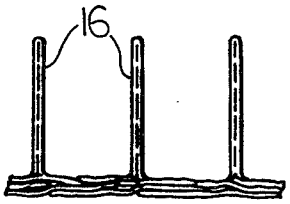
FIG. 6 is an enlarged and fragmentary diagrammatic view of a side edge portion of the heat exchanger tube of FIG. 1 to better illustrate the cross-sectional construction of the flattened edge portions.

The corrugated sheet 10 of FIG. 4 is placed in a suitable die and controllably crushed normal to the general plane thereof to the extent shown in FIG. 5 in order to produce opposite flattened side edge portions 30 and 32, opposite flattened end edge portions 34 and 36, and a flattened center section 38. As is apparent when viewing the end view thereof in FIG. 7, such crushing operation provides a first corrugated sheet portion or first group of ribs 40 and a second corrugated sheet portion or second group of ribs 42. It is significant to note that the upright ribs of both portions extend in the same direction away from the common internal plane 28 thereof. Both portions are similar in construction, and the tapered ends 44 of each rib are outwardly convergingly sloped or inclined by the die to better merge into the flattened side edge portions and the flattened center section. Moreover, the enlarged side view of FIG. 6 diagrammatically illustrates how the ribs of the sheet corrugations are overlappingly collapsed in a repetitious geometric pattern, which construction is typical for both the side edge portions and the center section. Such preselected overlapping of the sheet material results in from 3 to 7 layers of sheet thickness and a substantially controlled amount of stiffness for the edge portions and the center section.

Figure 1:
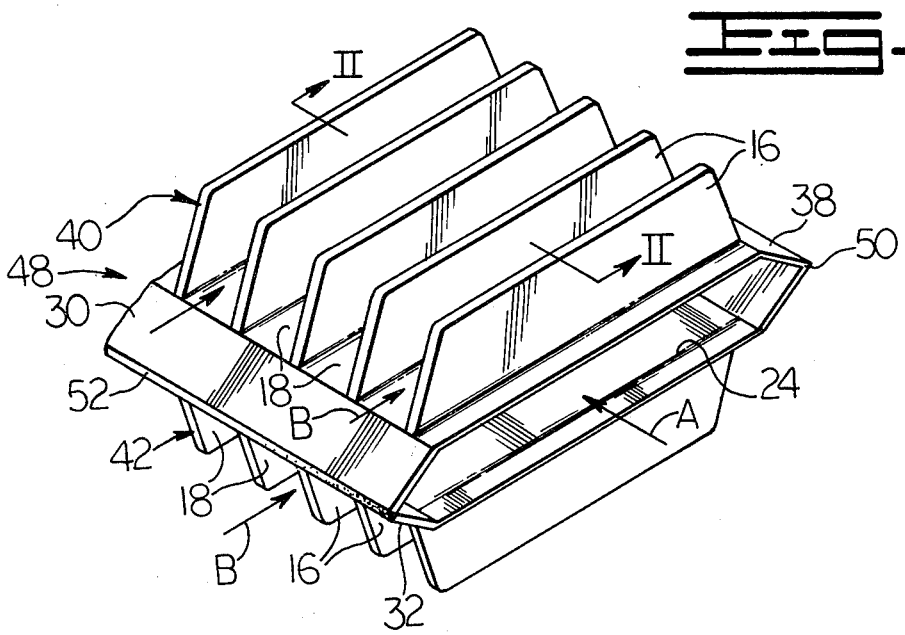
FIG. 1 is a diagrammatic, fragmentary, and enlarged perspective view of a cross flow heat exchanger tube constructed in accordance with the present invention.
Figure 7:
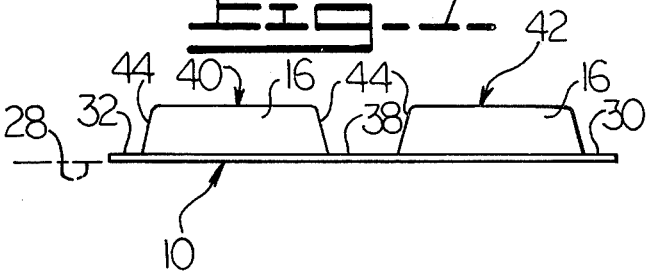
FIG. 7 is an end view of the flattened corrugated sheet of FIG. 5.
Figure 8:
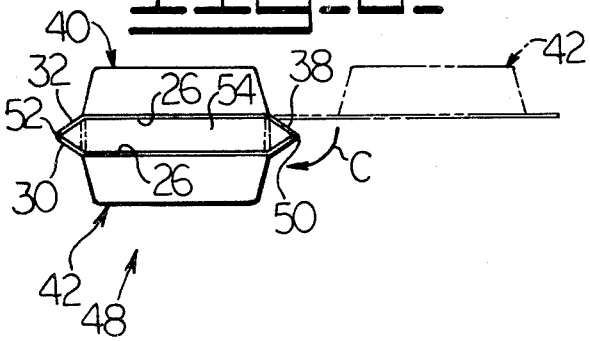
FIG. 8 is an end view similar to FIG. 7, only showing one portion after it has been folded approximately 180° about a center line thereof.

The crushed sheet 10 illustrated in FIG. 7 is subsequently formed into a flattened cross-flow heat exchanger tube 48 as shown in FIGS. 1 and 8 by folding it in half, along a centerline of the center section 38, with one half of the sheet containing the first group of ribs 40 and the other half containing the second group of ribs 42, and with both arranged in a mirror image manner. As best shown in FIG. 8, the second group of ribs illustrated in phantom is folded in a clockwise manner some 180° about the centerline when viewing the drawing and as indicated by the arrow identified by the letter C, so that the second group of ribs is positioned in parallel to the first group of ribs and with their respective inner surfaces 26 spaced apart in substantially parallel relation. Simultaneously, in the instant example, the center section is angularly inclined away from both groups of these inner surfaces to provide an acute angle in section and a longitudinally extending side edge 50 which is already fluid-tight. The opposite side edge portions 30 and 32 are also angularly inclined away from these inner surfaces so that they abut at their outer edges along their lengths to define an opposite longitudinally extending side edge or joint 52. Subsequently, the side edge 52 is brazed or welded into a fluid-tight seal to define an internal fluid passageway or path 54 within the tube.

It is contemplated that the center section 38 need not be angularly inclined to provide an acute angle and side edge 50 as is disclosed in FIG. 8, but rather the center section could extend between the first and second group of ribs 40 and 42 in an arcuate manner or in a manner at right angles to the planes of the inner surfaces 26 as shown in broken lines at the left side of FIG. 8 since it would still be fluid-tight. Similarly, the opposite side edge portions 30 and 32 could be formed as portions of an arc in cross-section or could be substantially aligned with each other and disposed in a plane substantially normal to the planes of the inner surfaces 26 before connection at the joint 52 as shown in broken lines. A typical length for the ribs may be about 61 mm (2.4"), and a typical spacing between the opposite inner surfaces 26 may be about 2 mm (0.080").

Figure 2:
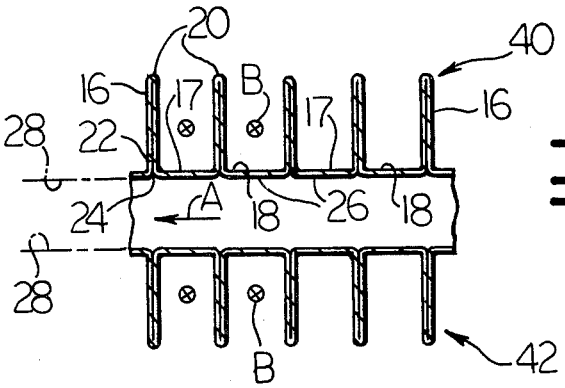
FIG. 2 is a longitudinal sectional view of the heat exchanger tube of FIG. 1 as taken along the line II—II thereof.
Figure 3:
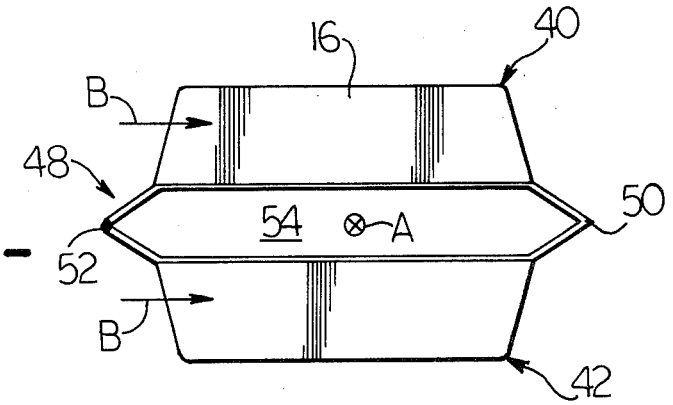
FIG. 3 is an end view of the heat exchanger tube of FIG. 1.

Referring now to FIGS. 1, 2 and 3, it is to be appreciated that the heat exchanger tube 48 provides efficient transfer of heat from a first fluid, such as water, traveling through the internal path 54 as indicated by the arrow A, to a second fluid, such as air, traveling along a plurality of external flow paths or channels 18 between the first and second groups of ribs 40 and 42 as indicated by arrows B. Thus, the flow direction arrows A and B define an effective cross flow relationship and, further, serve to indicate that the exposed external surface area is significantly greater than the exposed internal surface area.

DESCRIPTION OF A FIRST ALTERNATE EMBODIMENT

Figure 9:
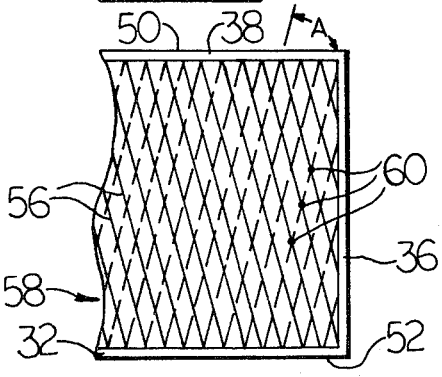
FIG. 9 is a diagrammatic and fragmentary plan view of a first alternate embodiment heat exchanger tube showing the inclined ribs thereof.
Figure 10:
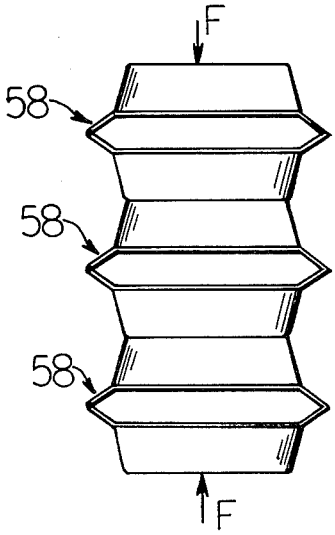
FIG. 10 is a diagrammatic end view of several of the heat exchanger tubes of the present invention arranged in a stacked row.

While the orientation of the ribs 16 of the basic embodiment of FIG. 1 is normal to the opposite sides, the modified embodiment shown in FIG. 9 contemplates inclining the ribs. Particularly, a plurality of inclined ribs 56 of the modified heat exchanger tube 58 are inclined at an angle A with respect to the side edges 50 and 52. With this construction several of the modified tubes may be stacked in a row with the ribs thereof disposed in criss-cross relation, and as illustrated in FIG. 10, to present a relatively rigid tube row construction. Note that the ribs are inclined in opposite directions as respectively shown in solid lines and broken lines in FIG. 9 at the opposite surfaces of the tube as a result of the folding process described previously in connection with FIGS. 7 and 8. For example, internesting of the ribs is prevented between adjacent tubes because their apexes contact one another at a large plurality of cross-over points as generally indicated by the reference number 60.

DESCRIPTION OF A SECOND ALTERNATE EMBODIMENT

Figure 11:
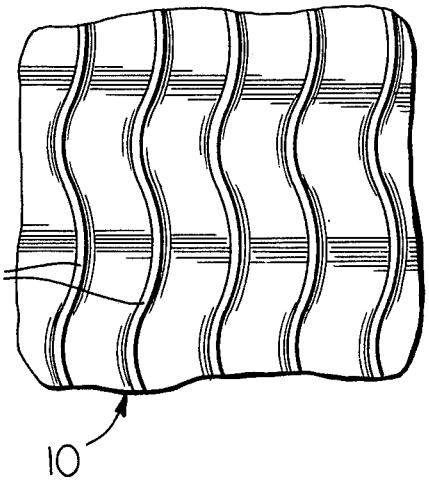
FIG. 11 is an enlarged, fragmentary, and diagrammatic plan view of a second alternate embodiment heat exchanger tube showing undulating or serpentine ribs.

A second alternate embodiment is shown in FIG. 11, wherein the ribs 62 undulate in a serpentine or sinuous wave pattern in plan view and in the general direction of external fluid flow in order to increase the stiffness of the tube, to improve the overall heat exchanger effectiveness by promoting increased turbulence, and to promote stacking. In connection with stacking it is to be recognized that the sinuous waves can be arranged out of phase with each other so that the apexes of the juxtaposed ribs are criss-crossed substantially as noted above.

DESCRIPTION OF A THIRD ALTERNATE EMBODIMENT

Figure 12:
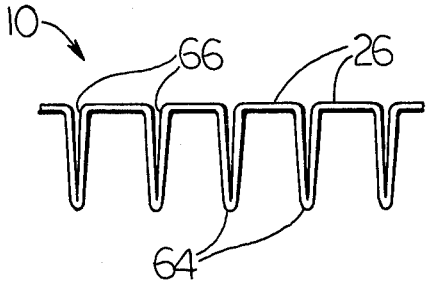
FIG. 12 is a fragmentary and enlarged longitudinal sectional view showing the asymmetric corrugated sheet construction of a third alternate embodiment heat exchanger tube.

As shown in FIG. 12, the third alternate embodiment corrugated sheet 10 has a plurality of compressed V-shaped ribs 64 with a relatively narrow wedge-shaped slot 66 defined at each of the ribs. During compressing of the pleats of the corrugations together to form the ribs, it has been found that some opening of the slot may occur because of the inherent resiliency of the sheet material. For example, the slot may open to a width less than about 0.1 mm (0.004"). However, such minor degree of opening does not interrupt to any substantial degree the flow of fluid smoothly along the internal surfaces 26, and may prove advantageous in improving the heat transfer coefficient at the inside surfaces of the tube.

DESCRIPTION OF A FOURTH ALTERNATE EMBODIMENT

Figure 13:
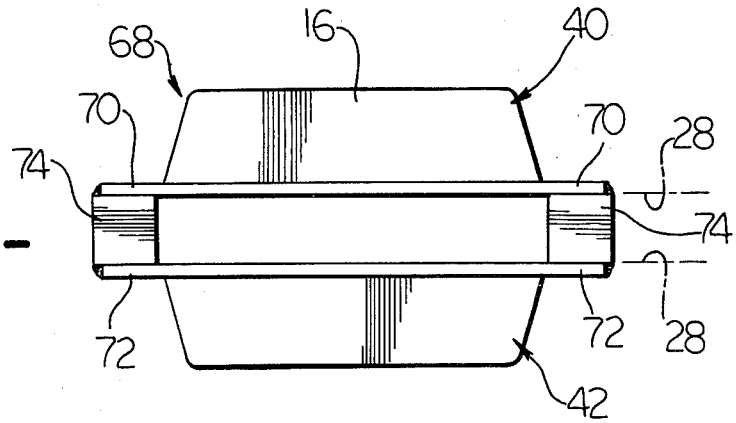
FIG. 13 is a diagrammatic end elevational view of a fourth alternate embodiment heat exchanger tube.

A fourth alternate embodiment heat exchanger tube 68 is shown in FIG. 13 which retains the generally smooth or uninterrupted inner surface construction of the first group of ribs 40 and the second group of ribs 42 as defined in the basic embodiment, but which groups may be individually separately formed. In this example, the first group of ribs is bounded by a pair of flattened side edge portions 70 which remain oriented generally in the plane 28. The second group of ribs is likewise bounded by a pair of flattened side edge portions 72, and may be either separately made or cut from the crushed sheet illustrated in FIG. 5. Seal means or steel spacer bars 74 are each inserted between the respectively facing side edge portions 70 and 72, and are preferably welded or otherwise secured in place to the juxtaposed side edge portions to define the boundaries of the tube. Preferably, tungsten inert gas (TIG) welding is employed to seal the joints because, as noted previously, the sheet material is quite thin.

Thus, it is apparent that the present invention provides a heat exchanger tube of flattened tube-fin construction which can be as long or wide as desired, and which utilizes integral ribs of varied construction to promote heat transfer from a fluid traveling within the tube to a fluid traveling in a cross flow direction exteriorly thereof. Because of the asymmetric construction of the corrugated portions more surface area is provided exteriorly of the tube than internally. Such area ratio is particularly advantageous when hot water or the like passes through the tube and ambient air passes exteriorly across the tube.

Furthermore, the heat exchanger tube of the present invention is relatively economical to produce and offers the advantage of providing as few as one longitudinally oriented sealing joint 52 exteriorly thereof. Such joint is somewhat thicker and stronger because of the application of additional welding or brazing material thereto and presents a more wear-resistant edge in the event that the tube is exposed to air-carried sand or the like. However, if both side edges 50 and 52 of the tube are weldably connected and sealed together, they are still readily accessible for repair.

It is to be understood that a plurality of the tubes 48 may be arranged in rows and sealingly connected at their end edge portions 34 to a fluid carrying intake manifold or heat source and at their end edge portions 36 to an outlet manifold, not shown, to provide a radiator core for a vehicle. Since a row of the juxtaposed tubes may swell when subjected to internal pressure, such an assembly may require a restraining frame, also not shown, which would apply a restraining force F to the opposite ends of the row as indicated in FIG. 10. Such frame not only prevents the row of tubes from swelling laterally, but also ties the manifolds together.

While stainless steel sheeting is sufficient for most radiator applications because it resists corrosion and wear by air-borne particles, and may be preferred in many applications, it is to be understood that plain carbon steel, copper, brass, aluminum, and even non-metallic materials such as plastics could be utilized with equal success for other environmental circumstances.

Other aspects, objects and advantages of this invention can be obtained from a study of the drawings, the disclosure, and the appended claims.

The embodiments of the invention in which an exclusive property or privilege is claimed are defined as follows:

1. A heat exchanger tube (48,68) comprising:

a first asymmetrically corrugated sheet portion (40) having an opposite pair of longitudinally extending side edge portions (32,38,70), a plurality of substantially transversely extending ribs (16), and a plurality of substantially flat members (17) integrally connected to said ribs (16), each rib (16) having a flattened V-shape such that said members (17) define a first plurality of juxtaposed inner surfaces (26);

a second asymmetrically corrugated sheet portion (42) having an opposite pair of longitudinally extending side edge portions (30,38,72), a plurality of substantially transversely extending ribs (16), and a plurality of substantially flat members (17) integrally connected to said ribs (16), each rib (16) having a flattened V-shape such that said members (17) define a second plurality of juxtaposed inner surfaces (26); and means (50,52,74) for connecting said side edge portions (30,32,38,70,72) of said first and second corrugated sheet portions (40,42), spacing said first and second plurality of inner surfaces (26) apart, forming a tube (46,68) and providing an internal flow path (54) extending generally longitudinally therethrough and a plurality of external flow paths (18) extending generally transversely to said internal flow path (54).

2. The heat exchanger tube (68) of claim 1 wherein said connecting means (50,52,74) includes a spacer member (74) joiningly connecting each respective pair of said side edge portions (70,72).

3. The exchanger tube (48, 68) of claim 1 wherein said first plurality of inner surfaces (26) of said first corrugated sheet portion (40) is arranged in a first plane, and said second plurality of inner surfaces (26) of said second corrugated sheet protion (42) is arranged in a second plane, said first and second planes being substantially flat and parallel.

* * * * *